US005482820A

United States Patent [19]

Cellone et al.

[11] Patent Number: 5,482,820

[45] Date of Patent: Jan. 9, 1996

[54] SILVER HALIDE PHOTOGRAPHIC ELEMENTS CONTAINING BIOCIDES

[75] Inventors: Luigi Cellone, Albisola Marina; Franco Leoncini, Genova, both of Italy

[73] Assignee: Minnesota Mining and Manufacturing Company, St. Paul, Minn.

[21] Appl. No.: 382,898

[22] Filed: Feb. 3, 1995

[30] Foreign Application Priority Data

Mar. 15, 1994 [EP] European Pat. Off. ..... 94103953.9

[51] Int. Cl.[6] ..... G03C 1/37

[52] U.S. Cl. ..... 430/523; 430/507; 430/510; 430/631; 430/640

[58] Field of Search ..... 430/523, 507, 430/510, 631, 640, 607

[56] References Cited

U.S. PATENT DOCUMENTS 3,778,276 12/1973 Shaw et al. .

4,923,790 5/1990 Kato et al. ..... 430/523

FOREIGN PATENT DOCUMENTS

| | | |
|---|---|---|
| 281265A5 | 1/1990 | Germany . |
| 59-228247 | 12/1984 | Japan . |
| 3247747 | 10/1988 | Japan . |
| 1253727 | 10/1989 | Japan . |
| 1-253727 | 10/1989 | Japan . |
| 3130759 | 6/1991 | Japan . |

*Primary Examiner*—Thorl Chea

*Attorney, Agent, or Firm*—Gary L. Griswold; Walter N. Kirn; Mark A. Litman

[57] ABSTRACT

There is disclosed a light-sensitive silver halide photographic element comprising at least one hydrophilic colloid layer containing a dihalogenonitriloacylamino compound in combination with a phenolic biocide.

14 Claims, No Drawings

SILVER HALIDE PHOTOGRAPHIC ELEMENTS CONTAINING BIOCIDES

FIELD OF THE INVENTION

This invention relates to silver halide photographic elements and, more in particular to silver halide photographic elements having improved antifungal and antibacterial properties.

BACKGROUND OF THE INVENTION

Light-sensitive silver halide photographic elements generally comprise one or more light-sensitive silver halide emulsion layers coated on a support and, if required, one or more light-insensitive auxiliary layers such as subbing layers, intermediate layers, antihalation layers, filter layers and protective layers. As the binders for these constituting layers of the photographic elements, hydrophilic colloids are generally used such as gelatin, gelatin derivatives (such as carbamylated gelatins, acylated gelatins and phthalated gelatins), gelatins graft polymerized with vinyl monomers (such as acrylic acid, methacrylic acid and acrylonitrile), alginic acid, colloidal albumin, cellulose derivatives (.such as carboxymethyl cellulose and hydroxyethyl cellulose), synthetic hydrophilic binders (such as polyvinyl alcohol, polyacrylamide and polyvinylpyrrolidone) and other water-soluble or water-penetrable polymers known in the art, used alone or in mixture of two or more thereof.

It is known that hydrophilic colloids of the photographic elements, as well as aqueous solutions of said hydrophilic colloids, are susceptible to microbial contamination by microorganisms such as bacteria, yeasts and fungi. The microbiological growth causes physical and sensitometric defects in the silver halide photographic elements which are visible upon exposure and processing of said elements.

To prevent or inhibit microbiological growth, it is known to add a biocide into the coating compositions or the silver halide photographic elements. Many biocides have been used in the field of silver halide photography to prevent the aqueous gelatin solutions and the photographic elements from being attacked by bacterial action. Examples of biocides include phenol compounds (such as phenol, thymol, pentachlorophenol, cresol, p-chloro-m-xylenol), aldehydic compounds (such as formaldehyde, glutaraldehyde, paraformaldehyde), acid compounds (such as benzoic acid, sorbic acid, mucochloric acid, mucobromic acid), esters of p-hydroxybenzoic acid (such as methyl-p-hydroxybenzoate, butyl-p-hydroxybenzoate), rare earth salts, amines, disulfides, heterocyclic compounds (such as thiazinium salts, thiazolinones, benzimidazoles), quaternary ammonium salts and organic mercury compounds, used alone or in combination thereof. Combinations of biocides are described, for example, in U.S. Pat. No. 4,923,790 (thiazolylbenzimidazoles combined with phenol compounds and/or thiazolinones), JP 63-257747 (hydroxyalkylphenyl ethers and benzothiazolinones), JP 03-130759 (hydroxyalkyphenyl ethers and esters of p-hydroxybenzoic acid), and DD 281,265 (esters of p-hydroxybenzoic acid and alkyl- or aryl-sulfonates).

Some of the above mentioned biocides must be used in large amounts to be effective. Others have a disagreeable smell, are toxic or irritants. Still others affect the sensitometric properties of the photographic elements and produce fog in the photographic emulsions.

SUMMARY OF THE INVENTION

The present invention relates to a light-sensitive silver halide photographic element which comprises at least one hydrophilic colloid layer comprising a dihalogenonitriloacylamino compound in combination with a phenolic biocide.

It has been found that the combination of the present invention can be used to prevent biological growth in aqueous hydrophilic colloid solutions which are to be used for preparation of photographic elements. The combination is effective in small amounts and does not affect the sensitometric properties of the photographic element in which it has been included.

DETAILED DESCRIPTION OF THE INVENTION

The dihalogenonitriloacylamino compounds for use in the combination of the present invention can be represented by the following formula (I)

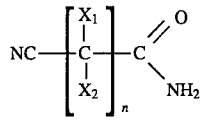

(I)

wherein $X_1$ and $X_2$ each represents hydrogen or a halogen atom and n represents the number of methylene groups in the compound and has a value of 1, 2 or 3, with the proviso that at least one methylene group has at least two halogen atoms bounded thereto to form a dihalomethylene group. It is preferred that any of these methylene groups having halogen atoms bonded thereto be a dihalomethylene group. Examples of halogen atoms represented by $X_1$ and $X_2$ include chlorine, bromine and iodine.

Specific examples of the compounds represented by formula (I) are illustrated below, but the present invention is not to be construed as being limited thereto.

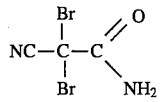

I-1

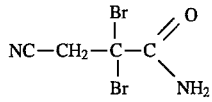

I-2

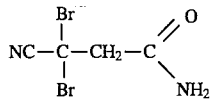

I-3

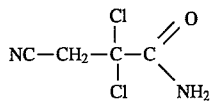

I-4

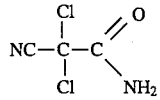

I-5

The compounds represented by the formula (I) are described in JP 01-253727.

According to the present invention the dihalogenonitriloacylamino compounds are employed in combination with at least one phenolic biocide, i.e. a compound having a central nucleus of formula:

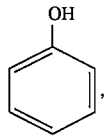

such as those represented by the formulae (II) and/or (III)

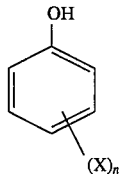

(II)

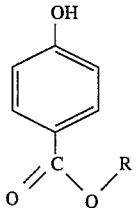

(III)

wherein X represents a halogen atom, an alkyl group, a cycloalkyl group, an aryl group, a carboxyl group, an amino group, a hydroxy group, an alkoxy group, an alkoxycarbonyl group, a sulfo group or a nitro group; n represents 0 or an integer 1 to 5, provided that when n is 2 or more, each X may be the same or different; and R represents an alkyl group or an aryl group. The hydroxy group may be in the form of a salt with an alkaline metal atom (e.g., sodium, potassium). The halogen atom represented by X is preferably Cl, Br or I, and more preferably is Cl. The alkyl group represented by X is preferably a straight-chain or branched-chain alkyl group having 1 to 4 carbon atoms (e.g., methyl, ethyl, n-propyl, iso-propyl, n-butyl, sec-butyl, tert-butyl). The cycloalkyl group represented by X is preferably a cycloalkyl group having 4 to 8 carbon atoms (e.g., cyclopentyl, cyclohexyl). The aryl group represented by X is preferably an aryl group having 6 to 12 carbon atoms (e.g., phenyl, naphthyl). The alkoxy group represented by X is preferably an alkoxy group having 1 to 4 carbon atoms (e.g., methoxy, ethoxy, n-propoxy, iso-propoxy, n-butoxy, iso-butoxy). The alkoxy carbonyl group represented by X is preferably an alkoxy group having 1 to 4 carbon atoms (e.g. methoxycarbonyl, ethoxycarbonyl, propoxycarbonyl, butoxycarbonyl). The alkyl group represented by R is preferably a straight-chain or branched-chain alkyl group having 1 to 4 carbon atoms (e.g., methyl, ethyl, n-propyl, iso-propyl, n-butyl, sec-butyl, tert-butyl). The aryl group represented by R is preferably an aryl group having 6 to 12 carbon atoms (e.g., phenyl, naphthyl). These substituents may be substituted by an alkyl group of 1 to 4 carbon atoms, a halogen atom, a hydroxy group, a sulfo group, a nitro group, an amino group, a cyano group, a carboxy group or a phenyl group.

When the term "group" or "nucleus" is used in this invention to describe a chemical compound or substituent, the described chemical material includes the basic group or nucleus and that group or nucleus with conventional substitution. Where the term "moiety" is used in this invention to describe a chemical compound or substituent, only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, octyl, stearyl, cyclohexyl, etc.

Specific examples of compounds of general formulas (II) and (III) will be shown hereinafter, but the present invention should not be construed as being limited thereto.

| | |
|---|---|
| II-1 | phenol |
| II-2 | p-chlorophenol |
| II-3 | m-chlorophenol |
| II-4 | 2,4,6-trichlorophenol |
| II-5 | pentachlorophenol |
| II-6 | p-cresol |
| II-7 | m-cresol |
| II-8 | 4-chloro-m-cresol |
| II-9 | 2-chloro-p-cresol |
| II-10 | p-xylenol |
| II-11 | 2,6-dimethylphenol |
| II-12 | p-chloro-m-xylenol |
| II-13 | tribromophenol |
| II-14 | 2-ethyl-4-bromophenol |
| II-15 | salicylic acid |
| II-16 | 2-hydroxy-5-chlorobenzoic acid |
| II-17 | p-hydroxybenzoic acid |
| II-18 | o-phenylphenol |
| II-20 | o-cyclohexylphenol |
| II-21 | 2-cyclohexyl-4,6-dinitrophenol |
| II-22 | p-nitrophenol |
| III-1 | N-methyl-p-hydroxybenzoate |
| III-2 | N-ethyl-p-hydroxybenzoate |
| III-3 | N-propyl-p-hydroxybenzoate |
| III-4 | N-butyl-p-hydroxybenzoate |
| III-5 | N-benzyl-p-hydroxybenzoate |

The compounds represented by formulae (II) and (III) are commercially available products.

The layer including as biocides the compounds of the present invention represented by formulae (I) and (II) or (III) may be any one of, or more than one of the hydrophilic colloidal layers which constitute the light-sensitive silver halide material, such as a light-sensitive silver halide emulsion layer, a subbing layer, a filter layer, an antihalation layer or a protective layer. They can be used in combination in the same layer, or separately in different layers of the same light-sensitive photographic material.

The compound represented by the formula (I) can be used in an amount of $5'10^{-4}$ to 1.0 % by weight more preferably $2.5\times10^{-3}$ to 0.1% by weight, most preferably $1\times10^{-3}$ to $2.5\times10^{-2}$ % by weight, with respect to the total hydrophilic colloid of the element. The compound represented by the formula (II) or (III) can be used in an amount of $1\times10^{-3}$ to 5.0% by weight, more preferably $5\times10^{-3}$ to 1.0% by weight, most preferably $2.5\times10^{-3}$ to 0.5% by weight, with respect to the hydrophilic colloid. Of course, the above ranges may vary toward higher or lower amounts with the type of the hydrophilic colloid, the kind of silver halide photographic element, additives to be added, experimental conditions and the like.

The biocides for use in the present invention can be incorporated into the silver halide emulsion layers or other hydrophilic colloid layers in water-permeable relationship therewith according to any technique known to those skilled in the art for incorporating photographic additives into colloidal compositions. Usually, the biocides may be dissolved in a solvent, which does not adversely affect photographic performances, e.g., water or organic solvent such as methanol, ethanol, acetone, benzyl alcohol ethanolamine and ethylene glycol, and the resulting solution may be then added to the hydrophilic colloid coating compositions, or be used to coat a protective layer. Alternatively, the biocides for use in the present invention may be emulsion dispersed in the presence of a surface active agent in a high boiling solvent or a low boiling solvent or a mixture thereof and then incorporated in a hydrophilic colloid coating composition.

In a preferred embodiment of the present invention, the compounds of formulae (I) and (II) or (III) may be used in combination with a compound acting as inactivating agent for proteolytic enzymes. In fact, gelatin is not directly consumed by pathogenic bacteria which contaminate the gelatin solutions because of the large size of gelatin's polypeptide molecules. Pathogenic bacteria generate a proteolytic enzyme which catalyzes the hydrolysis of gelatin into smaller polypeptides, peptides, and amino acids which are capable of passing through the bacteria cell walls, thus supporting the intracellular metabolism necessary for the organism growth and reproduction. Biocides are direct towards slowing down the living processes of organisms, but do very little in inactivating the proteolytic enzymes already present. As enzyme inhibitors for use in combination with the biocides corresponding to formulae (I) and (II) or (III) the following compounds may be used: iodoacetic acid, alkali metal fluorides (e.g., sodium fluoride, potassium fluoride), potassium fluorosilicate, L-1-tosylamino-2-phenethylchloromethylketone (TPCK), benzyloxycarbonyl-phenylalanine-bromomethylketone (ZPBK) and benzyloxycarbonyl-phenylalanine-chloromethylketone (ZPCK). TPCK is described in U.S. Pat. No. 3,503,746, and ZPBK and ZPCK are described in U.S. Pat. No. 3,778,276. The biocides thus control the bacteria that produce enzymes and the enzyme inhibitor inactivates the enzymes from attacking the gelatin.

The silver halides employed in this invention may be for use in any silver halide photographic emulsion, such as silver chloride, silver bromide, silver iodide, silver chlorobromide, silver chloroiodide, silver iodobromide and silver chloro-iodobromide.

The grains of these silver halides may be coarse or fine, and the grain size distribution of them may be narrow or extensive. Further, the silver halide grains may be regular grains having a regular crystal structure such as cube, octahedron, and tetradecahedron, or the spherical or irregular crystal structure, or those having crystal defects such as twin planes, or those having a tabular form, or combinations thereof. Furthermore, the grain structure of the silver halides may be uniform from the interior to exterior thereof, or be multilayer.

According to a simple embodiment, the grains may comprise a core and a shell, which may have different halide compositions and/or may have undergone different modifications such as the addition of dopants. Besides having a differently composed core and shell, the silver halide grains may also comprise different phases inbetween. Furthermore, the silver halides may be of such a type as allows a latent image to be formed mainly on the surface thereof or such a type as allows it to be formed inside the grains thereof.

The silver halide emulsions which can be utilized in this invention may be prepared according to different methods as described in, for example, *The Theory of the Photographic Process,* C. E. K. Mees and T. H. James, Macmillan (1966), *Chimie et Physique Photographique,* P. Glafkides, Paul Montel (1967), *Photographic Emulsion Chemistry,* G. F. Duffin, The Focal Press (1966), *Making and Coating Photographic Emulsion,* V. L. Zelikman, The Focal Press (1966), in U.S. Pat. No. 2,592,250 or in GE Pat. No. 635,841.

The emulsions can be desalted to remove soluble salts in the usual ways, e.g., by dialysis, by flocculation and redispersing, or by ultrafiltration, but emulsions still having soluble salts are also acceptable.

As the binder of protective colloid for use in the photographic element, gelatin is advantageously used, but other hydrophilic colloids may be used such as gelatin derivatives, colloidal albumin, gum arabic, colloidal hydrated silica, cellulose ester derivatives such as alkyl esters of carboxylated cellulose, hydroxy ethyl cellulose, carboxy methyl cellulose, synthetic resins, such as the amphoteric copolymers described in U.S. Pat. No. 2,949,442, polyvinyl alcohol, and others well known in the art. These binders may be used in admixture with dispersed (latex-type) vinyl polymers, such as those disclosed, for example, in U.S. Pat. Nos. 3,142,568, 3,193,386, 3,062,674, 3,220,844.

The silver halide emulsions can be sensitized with a chemical sensitizer as known in the art such as, for example, a noble metal sensitizer, a sulfur sensitizer, a selenium sensitizer and a reduction sensitizer.

The silver halide emulsions can be spectrally sensitized (ortho-, pan- or infrared-sensitized) with methine dyes such as those described in *The Cyanine Dyes and Related Compounds,* F. H. Hamer, John Wiley & Sons (1964). Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly useful dyes are those belonging to the class of cyanine dyes, merocyanine dyes and complex merocyanine dyes. Other dyes, which as such do not have any spectral sensitization activity, or certain other compounds, which do not substantially absorb visible radiation, can have a supersensitization effect when they are used in combination with said spectral sensitizing dyes. Among suitable sensitizers known in the art, heterocyclic mercapto compounds containing at least one electronegative substituent, nitrogen-containing heterocyclic ring-substituted aminostilbene compounds, aromatic organic acid/formaldehyde condensation products, cadmium salts and azaindene compounds are particularly useful.

The silver halide photographic elements according to the present invention may comprise compounds preventing the formation of fog or stabilizing the photographic characteristics during the production or storage of photographic elements or during the photographic treatment thereof, such as heterocyclic nitrogen-containing compound, arylthiosulfinic acids and arylthiosulfonic acids.

The photographic elements according to this invention may comprise other additives such as desensitizers, brightening agents, couplers, hardening agents, coating agents, plasticizers, lubricants, matting agents, high-boiling organic solvents, development accelerating compounds, UV absorbers, antistatic agents, antistain agents, and the like as described, for example, in Research Disclosure Vol. 176, No. 17643, December 1979.

The photographic elements according to this invention can be used for any of general black and white photography, graphic arts, X-ray, print, microfilm, electron-ray record, infrared-ray record, color photography and the like.

Useful photographic elements according to this invention are silver chloride emulsion elements as conventionally employed in forming halftone, dot, and line images usually called "lith" elements. Said elements contain silver halide emulsions comprising preferably at least 50 mole % of silver chloride, more preferably at least 80 mole % of silver chloride, the balance, if any, being silver bromide. If desired, said silver halides can contain a small amount of silver iodide, in an amount that is usually less than about 5 mole %, preferably less than 1 mole %. The average grain size of silver halide used in lith emulsions is lower than about 0.7 micrometers, preferably lower than about 0.4 micrometers, more preferably lower than 0.2 micrometers. The lith elements can include a hydrazine compound to obtain high contrast images. Any known-hydrazine compounds can be used, such as, for example, hydrazine compounds described in Research Disclosure 235, Item 23510, November 1983, *Development Nucleation by Hydrazine and Hydrazine Derivatives.* Other references to lith materials can be found in the same Research Disclosure.

Color photographic elements for use in the present invention comprise silver halide emulsion layers selectively sensitive to different portions of the visible and/or infrared spectrum and associated with yellow, magenta and cyan dye forming couplers which form (upon reaction with an oxidized primary amine type color developing agent) respectively yellow, magenta and cyan dye images. As yellow couplers, open chain ketomethylene compounds can be used, such as benzoylacetoanilide type yellow couplers and pyvaloylacetoanilide type yellow couplers. Two-equivalent type yellow couplers, in which a substituent capable of separating off at the time of coupling reaction attached to the carbon atom of the coupling position, can be used advantageously. As magenta couplers, pyrazolone type, pyrazolotriazole type, pyrazolinobenzimidazole type and indazolone type magenta couplers can be used. As cyan couplers, phenols and naphthols type cyan couplers can be used. Colored magenta couplers and colored cyan couplers can also be used advantageously, in addition to the above-mentioned couplers. For the purpose of improving sharpness and graininess of the image, the light-sensitive color materials used in this invention may additionally contain development inhibitor-releasing couplers or compounds.

Silver halide photographic elements for X-ray exposure to be used in the present invention comprise a transparent film base, such as a polyethyleneterephthalate film base, having on at least one of its sides, preferably on both of its sides, a silver halide emulsion layer. The silver halide emulsions coated on the sides may be the same or different and comprise silver halide emulsions commonly used in photographic elements, among which the silver bromide or silver bromoiodide emulsions being particularly useful for X-ray elements. The silver halide grains may have different shapes, for instance cubic, octahedral, spherical, tabular shapes, and may have epitaxial growth; they generally have mean grain sizes ranging from 0.2 to 3 micrometers, more preferably from 0.4 to 1.5 micrometers. Particularly useful in X-ray elements are high aspect ratio or intermediate aspect ratio tabular silver halide grains, as disclosed for example in U.S. Pat. Nos. 4,425,425 and 4,425,426, having an aspect ratio, that is the ratio of diameter to thickness, of greater that 5:1, preferably greater than 8:1. The silver halide emulsions are coated on the film base at a total silver coverage comprising in the range from about 2.5 to about 6 grams per square meter. Usually, the light-sensitive silver halide elements for X-ray recording are associated during X-ray exposure with intensifying screens as to be exposed to radiation emitted by said screens. The screens are made of relatively thick phosphor layers which transform X-rays into light radiation (e.g., visible light or infrared radiation). The screens absorb a portion of X-rays much larger than the light-sensitive element and are used to reduce radiation dose necessary to obtain a useful image. According to their Chemical composition, the phosphors can emit radiation in the blue, green, red or infrared region of the electromagnetic spectrum and the silver halide emulsions are sensitized to the wavelength region of the radiation emitted by the screens. Sensitization is performed by using spectral sensitizing dyes as known in the art. Particularly useful phosphors are the rare earth oxysulfides doped to control the wavelength of the emitted light and their own efficiency. Preferably are lanthanum, gadolinium and lutetium oxysulfides doped with trivalent terbium as described in U.S. Pat. No. 3,752,704. Among these phosphors, the preferred ones are gadolinum oxysulfides wherein from about 0.005% to about 8% by weight of the gadolinium ions are substituted with trivalent terbium ions, which upon excitation by UV radiation, X-rays, cathodic rays emit in the blue-green region of the spectrum with a main emission line at about 544 nm. The silver halide emulsions are spectrally sensitized to the spectral region of the light emitted by the screens, preferably to a spectral region of an interval comprised within 25 nm from the wavelength maximum emission of the screen, more preferably within 15 nm, and most preferably within 10 nm.

The light-sensitive silver halide photographic elements according to this invention can be processed after exposure to form a visible image according to processes which are generally employed for the light-sensitive elements for general black and white photography, X-ray, microfilm, lith film, print or color photography. In particular, the basic treatments steps of black and white photography include development with a black and white developing solution and fixation, and the basic treatment steps of color photography include color development, bleach and fixation. Processing formulations and techniques are described, for example, in *Photographic Processing Chemistry,* L. F. Mason, Focal Press (1966), *Processing Chemicals and Formulas,* Publication J-1, Eastman Kodak Company (1973), *Photo-Lab Index,* Morgan and Morgan, Dobbs Ferry (1977), *Neblette's Handbook of Photography and Reprography—Materials, Processes and Systems,* VanNostrand Reinhold, 7th Ed. (1977), and *Research Disclosure,* Item 17643 (December 1978).

Growth of bacteria and fungi can be markedly inhibited by the incorporation of the combination of the compound represented by the general formula (I) and the compound represented by the general formula (II) or (III) in light-sensitive photographic material. This effect is surprisingly greater than that obtained by independently using the compounds of general formulae (I), (II) and (III), and allows a reduced amount of biocides to be used.

Objects and advantages of this invention are further illustrated by the following examples, but the particular materials and amounts thereof recited in these examples, as well as other conditions and details, should not be construed to unduly limit this invention.

EXAMPLE 1

In order to determine the biocidal effect of the compounds of the general lo formulae (I) and (II) or (III), these compounds and known biocides were added to 100 ml of an aqueous solution of gelatin containing 10 g of gelatin in amounts shown in Table 1 to prepare samples as shown in Table 1. A culture of various organisms, including Gram + and Gram − bacteria, yeasts and fungi was inoculated into each sample, then each sample was kept at 25° C. for 168 hours to observe the growing state of organisms by rating for organism growth (biocidal effect=B.E.). Samples without organism growth were inoculated again, kept at 25° C. for 72 hours and rated again for organisms growth (residual biocidal effect=R.B.E.). Results of observations are reported in Table 1. Rating criteria are given after Table 1.

TABLE 1

| Sample | Compound and Added Amount (mg/l Kg gel) | B.E. | R.B.E. |
|---|---|---|---|
| 1 (comp) | I-2 (200) | – | nv |
| 2 (comp) | I-2 (500) | + | – |
| 3 (comp) | III-4 (20,000) | — | nv |
| 4 (comp) | II-18 (10,000) | — | nv |
| 5 (comp) | II-12 (1,000) | – | nv |
| 6 (comp) | II-12 (5,000) | ++ | + |
| 7 (comp) | II-5 (5,000) | + | + |
| 8 (comp) | II-1 (15,000) | + | + |
| 9 (comp) | II-12 (500) + A (100) | – | nv |
| 10 (comp) | II-12 (1,500) + A (100) | + | + |
| 11 (inv) | I-2 (100) + III-4 (2,000) | ++ | ++ |
| 12 (inv) | I-2 (100) + II-18 (1,000) | ++ | + |
| 13 (Inv) | I-2 (100) + II-12 (100) | + | + |
| 14 (inv) | I-2 (100) + II-12 (500) | ++ | ++ |
| 15 (inv) | I-2 (50) + III-4 (2,000) + A (70) | ++ | ++ |

++ = no growth
+ = very slight growth
– = moderate growth
— = heavy growth
A = L-1-tosylamino-2-phenethyl-chloromethylketone (TPCK)

As can be seen in the results of Table 1, the combinations of biocide compounds according to the present invention can remarkably inhibit the growth of organisms, and can be effective at reduced concentrations.

EXAMPLE 2

Inoculated samples 4, 5, 7, 13 and 15 of Example 1 were kept at 25° C. for 168 hours. Since the action of organisms results in a loss of viscosity, degradation of gelatin was measured by viscosity changes. The best biocides would expect to have the least viscosity change. The results of biocidal effect (B.E.) and viscosity change (% V.C.) are shown in Table 2.

TABLE 2

| Sample | Compound and Added Amount (mg/l Kg gel.) | B.E. | % V.C. |
|---|---|---|---|
| 4 | II-18 (10,000) | — | –50 |
| 5 | II-12 (1,000) | – | –32 |
| 7 | II-5 (5,000) | + | –27 |
| 13 | I-2 (100) + II-12 (100) | + | +2 |
| 15 | I-2 (50) + III-4 (2,000) + A (70) | ++ | –3 |

The above data indicate that substantially no viscosity change and, therefore, no gelatin degradation occurs employing the combination of biocide compounds according to the present invention.

EXAMPLE 3

A color photographic material was prepared by coating onto a subbed cellulose triacetate film support a high sensitivity blue-sensitive silver halide emulsion layer comprising a silver bromo-iodide emulsion (having 12% silver iodide moles and a mean grain size of 1.11 μm) at a silver coverage of 1.3 g/m$^2$ and a gelatin coverage of 1.80 g/m$^2$, chemically sensitized with sulfur and gold compounds, added with stabilizers and antifogging compounds and blue spectral sensitizing dyes. The layer was coated with 1.60 g/m$^2$ of the dye forming coupler A (Film 1 ).

A color photographic material was prepared as Film 1 but containing 150 mg of compound I-2 per Kg of gelatin and 500 mg of compound II-12 per Kg of gelatin (Film 2).

A color photographic material was prepared as Film 1 but containing 750 mg of compound I-2 per Kg of gelatin and 500 mg of compound II-12 per Kg of gelatin (Film 3).

Samples of each film were stored at different conditions: 15 days at room conditions, 7 days at 50° C. and 50% R.H., 7 days at 38° C. and 75% R.H. The samples were then exposed for 1/20 second to a light source having a color temperature of 5,500 K (white light exposure). All the exposed samples were developed in a standard type C41 process as described in *British Journal of Photography, Jul.* 12, 1974, pp. 597–598. The samples were then sensitometrically examined in both yellow and magenta layers. Sensitivity (S) is the relative speed measured at 0.1 above Dmin. Fog (Dmin) is the density at no exposure. The results are shown in Table 3.

TABLE 3

| Film | S (room cond.) | Dmin (room cond.) | S (50° C., 50% RH) | Dmin (50° C., 50% RH) | S (38° C., 75% RH) | Dmin (38° C., 75% RH) |
|---|---|---|---|---|---|---|
| 1 | 100 | 0.12 | 120 | 0.15 | 100 | 0.12 |
| 2 | 100 | 0.12 | 120 | 0.15 | 105 | 0.12 |
| 3 | 105 | 0.12 | 125 | 0.16 | 98 | 0.12 |

This example shows the photographic inertness of the combinations of compounds of the present invention when used in amounts even higher than those necessary to inhibit growth of fungi and bacteria in light-sensitive photographic materials.

Coupler A:

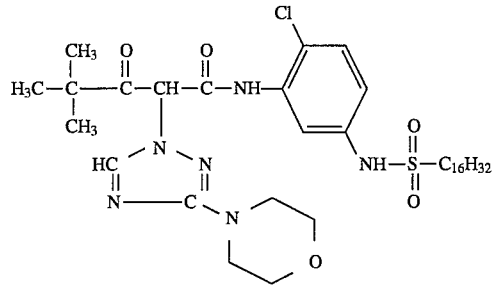

SILVER HALIDE PHOTOGRAPHIC ELEMENTS CONTAINING BIOCIDES

We claim:

1. A light-sensitive silver halide photographic element comprising hydrophilic colloid layers coated on a support, wherein at least one of said hydrophilic colloid layers is a silver halide emulsion layer, and wherein at least one of said hydrophilic colloid layers comprises a dihalogenonitriloacylamino compound in combination with a phenolic biocide.

2. The light-sensitive silver halide photographic material according to claim 1, wherein the dihalogenonitriloacylamino compound is represented by the formula (I)

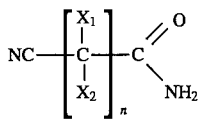

(I)

wherein $X_1$ and $X_2$ each represents hydrogen or a halogen atom and n represents the number of methylene groups in the compound and has the value of 1, 2 or 3, with the proviso that at least one methylene group has at least two halogen atoms bonded thereto.

3. The light-sensitive silver halide photographic material according to claim 1, wherein the phenolic biocide is at least one compound represented by formulae (II) and/or (III)

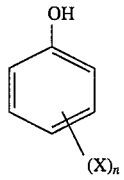

(II)

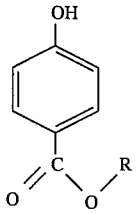

(III)

wherein X represents a halogen atom, an alkyl group, acycloalkyl group, an aryl group, a carboxyl group, an amino group, a hydroxy group, an alkoxy group, an alkoxycarbonyl group, a sulfo group or a nitro group; n represents 0 or an integer 1 to 5, provided that when n is 2 or more, each X may be the same or different; and R represents an alkyl group or an aryl group.

4. The light-sensitive silver halide photographic material according to claim 1, wherein the hydrophilic colloid layer is a silver halide light-sensitive layer.

5. The light-sensitive silver halide photographic material according to claim 1, wherein the hydrophilic colloid layer is a light-insensitive protective layer, inter-layer, filter layer, subbing layer or antihalation layer.

6. The light-sensitive silver halide photographic material according to claim 1, wherein the hydrophilic colloid is gelatin.

7. The light-sensitive silver halide photographic material according to claim 1, wherein the dihalogenonitriloacylamino compound is used in an amount of $5\times10^{-4}$ to 1.0% by weight with respect to the hydrophilic colloid.

8. The light-sensitive silver halide photographic material according to claim 1, wherein the phenolic biocide is used in an amount of $1\times10^{-3}$ to 5.0% by weight with respect to the hydrophilic colloid.

9. The light-sensitive silver halide photographic material according to claim 1, wherein the dihalogenonitriloacylamino compound and the phenolic biocide are used in combination with an enzyme inhibitor.

10. The light-sensitive silver halide photographic material according to claim 1, wherein the dihalogenonitriloacylamino compound is the following compound:

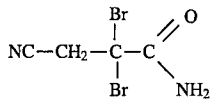

and the phenolic biocide is the following compound:

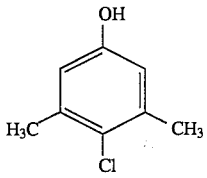

11. The light-sensitive silver halide photographic material according to claim 1, wherein said dihalogeno nitrilacylamino compound in combination with said phenolic biocide are added to a silver halide light-sensitive layer.

12. The light-sensitive silver halide photographic material according to claim 1, wherein said dihalogenonitriloacylamino compound in combination with said phenolic biocide are added to a light insensitive protective layer, interlayer, filter layer, subbing layer, or antihalation layer.

13. A light-sensitive silver halide photographic element comprising hydrophilic colloid layers coated on a support wherein at least one of said hydrophilic colloid layers is a silver halide emulsion layer and wherein at least one of said hydrophilic colloid layers contains antibacterial agents consisting essentially of a halogenonitriloacylamino compound in combination with a phenolic biocide.

14. A light-sensitive silver halide photographic element comprising hydrophilic colloid layers coated on a support wherein at least one of said hydrophilic colloid layers is a silver halide emulsion layer and wherein at least one of said hydrophilic colloid layers contains antibacterial agents consisting of a halogenonitriloacylamino compound in combination with a phenolic biocide.

* * * * *